US007069680B1

(12) United States Patent
Crawford

(10) Patent No.: US 7,069,680 B1
(45) Date of Patent: Jul. 4, 2006

(54) BARRIER OR WALL MOUNTING APPARATUS

(76) Inventor: Gregg Hugh Crawford, 721 W. Maple Ave., Adrian, MI (US) 49221

( * ) Notice: Subject to any disclaimer, the term of this patent is extended or adjusted under 35 U.S.C. 154(b) by 152 days.

(21) Appl. No.: 10/794,105

(22) Filed: Mar. 4, 2004

Related U.S. Application Data

(63) Continuation-in-part of application No. 10/335,721, filed on Jan. 2, 2003, now abandoned, and a continuation-in-part of application No. 10/176,319, filed on Jun. 19, 2002, now abandoned.

(51) Int. Cl.
*G09F 15/02* (2006.01)

(52) U.S. Cl. ..... 40/607.14; 40/612; 40/607.12; 248/228.4; 248/229.13; 24/502; 24/509

(58) Field of Classification Search ..... 40/612, 40/606.15, 607.1, 607.14, 606.01, 606.03, 40/606.16, 607.12, 652, 647; 248/214, 228.4, 248/229.13; 24/502, 507, 509; 269/254 CS; D8/72, 73; 404/9, 13
See application file for complete search history.

(56) References Cited

U.S. PATENT DOCUMENTS

| | | | | | |
|---|---|---|---|---|---|
| 1,343,641 | A * | 6/1920 | Patterson | 294/85 |
| D138,285 | S * | 7/1944 | Schneiderwind | D8/54 |
| 2,476,635 | A * | 7/1949 | Southwick | 248/317 |
| 2,556,615 | A * | 6/1951 | De Vaughn | 248/231.51 |
| 2,658,133 | A * | 11/1953 | Barrow | 219/138 |
| 2,708,557 | A * | 5/1955 | Clark | 246/477 |
| 2,898,069 | A * | 8/1959 | Kramer | 248/231.71 |
| 3,178,176 | A * | 4/1965 | Peyrebrune | 271/252 |
| 3,664,626 | A * | 5/1972 | Sneller | 248/224.7 |
| 3,743,228 | A * | 7/1973 | Drab | 248/228.4 |
| 4,249,832 | A * | 2/1981 | Schmanski | 404/6 |
| 4,481,729 | A * | 11/1984 | Weiller | 40/606.14 |
| 4,709,891 | A * | 12/1987 | Barnett | 248/214 |
| 5,208,585 | A * | 5/1993 | Sprague | 340/908.1 |
| 5,244,172 | A * | 9/1993 | Allega | 248/161 |
| 5,480,116 | A * | 1/1996 | Callas | 248/228.4 |
| 5,878,519 | A * | 3/1999 | Huyck et al. | 40/612 |
| 6,718,672 | B1 * | 4/2004 | Wieringa | 40/612 |
| 2005/0135878 | A1 * | 6/2005 | McNally et al. | 404/6 |

* cited by examiner

*Primary Examiner*—Gary C. Hoge

(57) ABSTRACT

There is disclosed a mounting apparatus which comprises a vertically extending rigid member having an upper end, a lower end and an intermediate portion, a clamping arm member having a generally horizontal arm have an end and a generally vertical arm having an end, a spring and a hinge assembly with a pivot axis coupling the end of the generally horizontal arm to the intermediate portion, a lever arm secured to the horizontal arm proximate the end thereof for pivoting the clamping arm member about the hinge axis to enlarge the space between the generally vertical arm and the lower end of the vertically extending rigid member to encompass the top of a barrier, and a communication affixing device on the upper end of the vertically extending rigid member for the mounting of visual and/or sound communication means such as a sign, signal, light, alarm, and/or detection means. In one embodiment, the barrier is a road divider such as a New Jersey Barrier, an F-shape barrier, a GM barrier, or a Constant-slope barrier.

16 Claims, 3 Drawing Sheets

BARRIER OR WALL MOUNTING APPARATUS

RELATED APPLICATIONS

This is a continuation in part under 35 USC 120 of U.S. utility patent application Ser. No. 10/335,721, filed Jan. 2, 2003 now abandoned and a continuation in part under 35 USC 120 of U.S. utility patent application Ser. No. 10/176,319, filed Jun. 19, 2002 now abandoned.

INTRODUCTION

This invention relates to a mounting device or apparatus for a barrier or wall such as used in the dividing of a road. The mounting apparatus is used to support and display a visual or sound communications means such as a sign, signal, light, alarm or detection device.

BACKGROUND

Road dividers or barriers have been disclosed in the prior art and include concrete barricade or wall structures with tapered or sloped walls as disclosed in U.S. Pat. No. 4,059,362 to Smith. The Smith structure was first used in New Jersey and is called the New Jersey Median Barrier.

According to Scott M. Kozel in *Roads to the Future*, other barrier structures include the Ontario tall-wall barrier which has the same tapers or slopes as the New Jersey Barrier, but is 42 inches high. The F-shape barrier is similar to the New Jersey Barrier, but the bottom section is lower and the taper or slope of each side wall is slightly flatter. The General Motors (GM) barrier is similar to the New Jersey Barrier, but is thicker with a slope breakpoint about three inches higher. A more recent structure is the Constant-slope barrier with a height of about 42 inches and sides of a single slope of about 79°.

The advantage of the New Jersey Barrier profile is to redirect a vehicle that hits it. The vehicle's wheels and body portion which impact the tapered barrier wall move upward so as to prevent vehicle rollover. The barrier may be constructed of density and weight sufficient to redirect heavy vehicles such as trucks and busses. New Jersey Median Barrier is typically very heavy, e.g., 600 pounds or more per linear foot of barrier. It may be cast-in-place or slip formed onto concrete footers with steel anchors.

RELATED PRIOR ART

The prior art does not disclose mounting devices for barriers or walls in accordance with the present invention. Typical prior art mounting devices for road signs are disclosed in U.S. patents:

U.S. Pat. No. 4,227,329 (Decaux);
U.S. Pat. No. 4,817,318 (Strauch);
U.S. Pat. No. 5,244,334 (Akita et al);
U.S. Pat. No. 5,400,997 (Payne et al);
U.S. Pat. No. 5,848,502 (Schaefer); and
U.S. Pat. No. 6,151,821 (Nakajima).

THE INVENTION

In accordance with this invention, there is provided a mounting apparatus and method to fit over barrier structure such as a road divider. The mounting apparatus may be used to support a sign, signal, light, alarm, detection device, or other visual and/or sound communication means. The detection device may be radar or a warning device as to vehicle speed or closeness to the wall.

More particularly, in accordance with this invention, there is provided a mounting apparatus and method for a communication means which comprises a vertically extending rigid member with an upper end, a lower end, and an intermediate portion, a clamping arm member having a generally horizontal arm and a generally vertical arm, a hinge and pivot axis assembly coupling an end portion of the generally horizontal arm to the intermediate portion, a lever arm secured to the horizontal arm proximate the end thereof for pivoting the clamping arm member about the hinge and pivot axis so as to enlarge the space between the generally vertical arm and lower end of said vertically extending rigid member and encompass the top of a barrier or wall, and a spring positioned in between and attached to the lever arm and rigid member to apply gripping compression between the clamping arm member and the rigid member and thereby secure the mounting apparatus to the barrier. An appropriate visual and/or sound communication means such as a sign, signal, light, alarm, detection device, etc. is attached to a mounting and/or supporting member fixed to the upper end of the vertically extending rigid member 2.

The barrier or wall mounting apparatus may include surface gripping members and other features as described in more detail below.

In one preferred embodiment hereof, the mounting apparatus is used to display a communication means such as a sign or light on a barrier structure with tapered or sloped walls such as a New Jersey Median Barrier, an Ontario tall-wall barrier, an F-shape barrier, a GM barrier, and/or a Constant-slope barrier as disclosed by Kozel cited above. The slope or taper of the opposite barrier walls may be the same or different. The slope or taper of a barrier wall may be constant or may vary.

In one embodiment, the mounting apparatus is used on a barrier structure with walls which are not tapered or sloped.

As used herein, road divider or barrier includes any permanent or temporary wall at any appropriate location including on or along a road or inside a building such as a parking garage. The barriers are typically constructed of any appropriate material including concrete, metal, or plastic. In some instances there is used a hollow plastic structure filled with sand or water.

Examples of prior art barriers are disclosed in Smith 362 cited above and U.S. Patents U.S. Pat. No. 4,502,812 (Zucker);
U.S. Pat. No. 4,769,191 (Diana);
U.S. Pat. No. 4,978,245 (White);
U.S. Pat. No. 5,123,773 (Yodock);
U.S. Pat. No. 5,145,278 (Lohrmann);
U.S. Pat. No. 5,409,249 (House et al);
U.S. Pat. No. 5,542,778 (Mallon); and
U.S. Pat. No. 6,679,649 (Capolupo).

DETAILED DESCRIPTION OF DRAWING AND BEST EMBODIMENT

Figure 1:
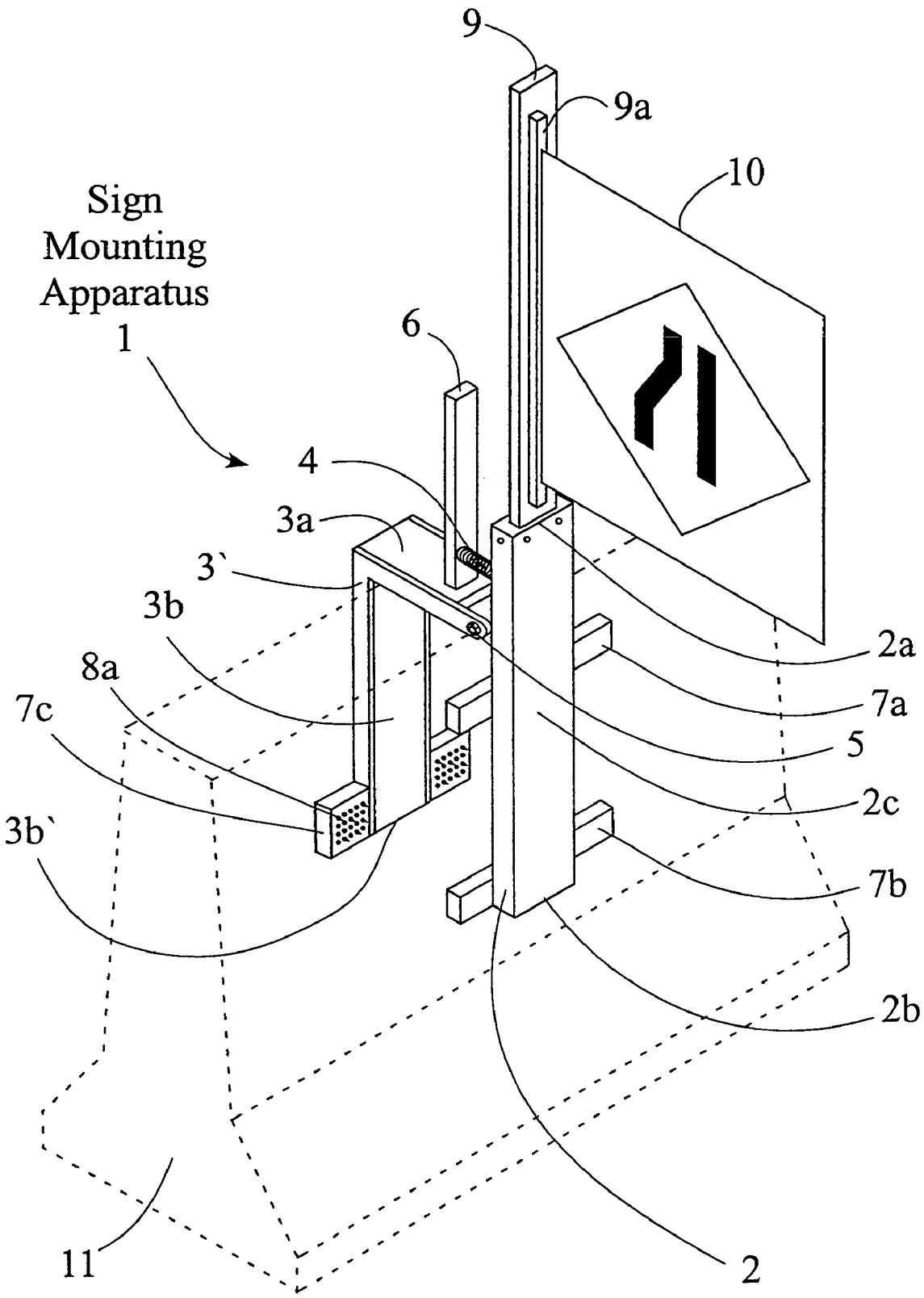
FIG. 1 is a perspective view of the sign mounting apparatus of this invention.
Figure 3:
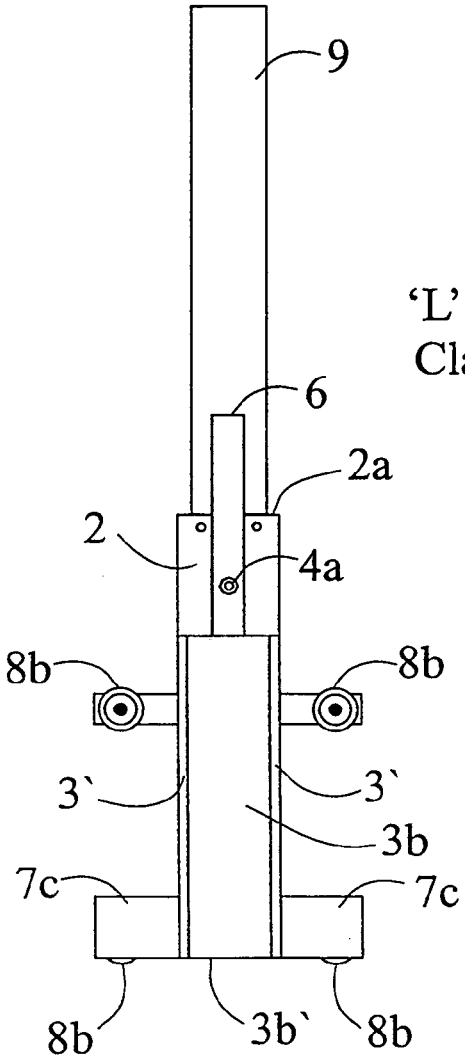
FIG. 3 is a left side view of FIG. 2.
Figure 2:
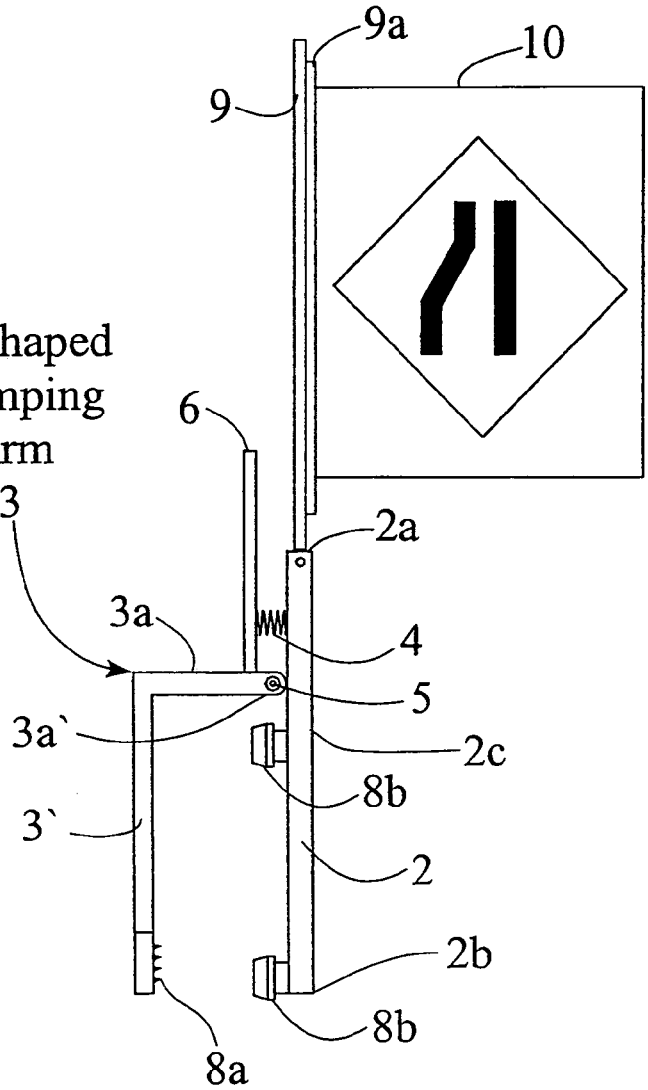
FIG. 2 is a side view of FIG. 1.
Figure 4:
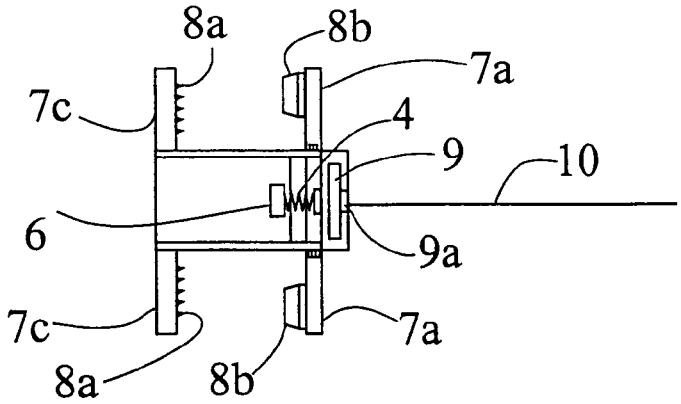
FIG. 4 is a top view of FIG. 2.
Figure 7:
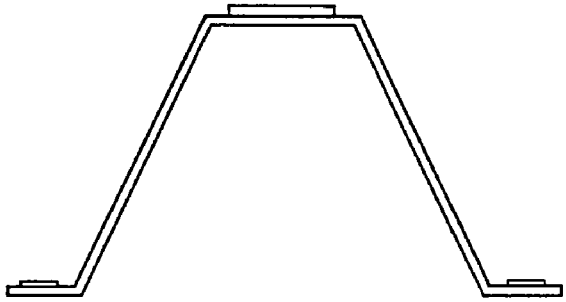
FIG. 7 is an end view of a barrier with another geometric shape.
Figure 6:
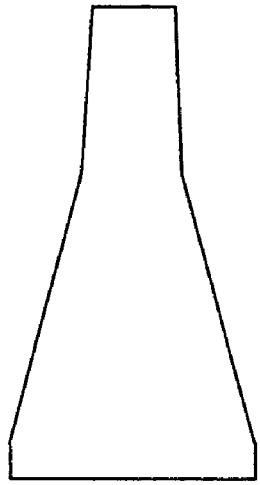
FIG. 6 is an end view of a barrier with a different geometric shape.
Figure 5:
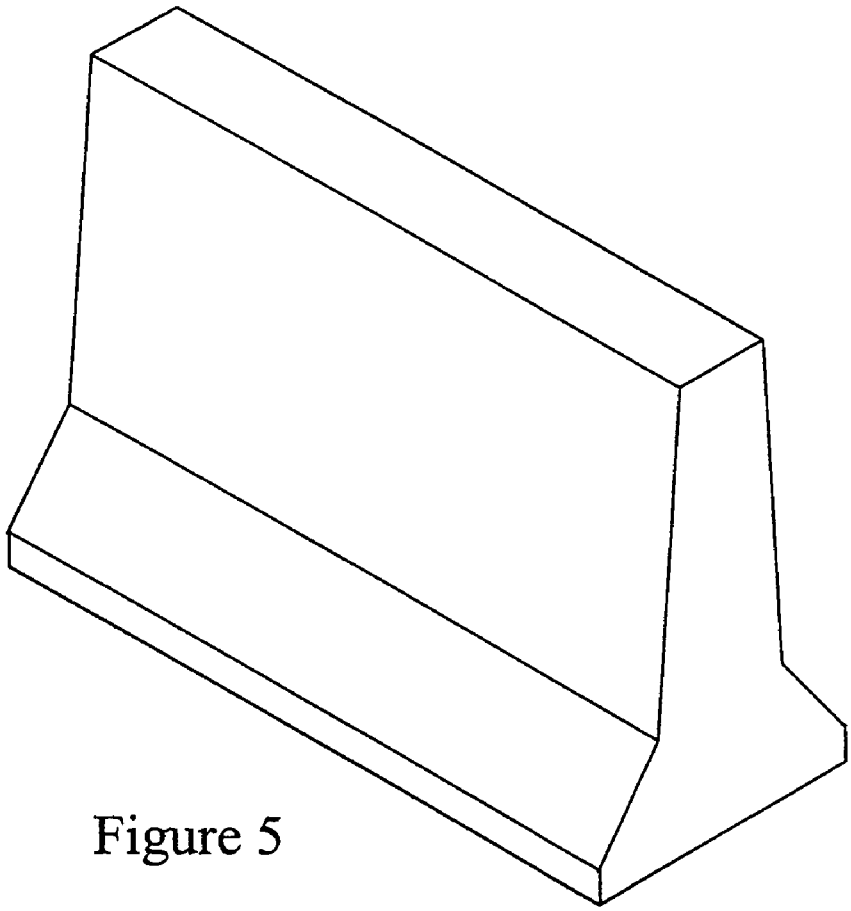
FIG. 5 is a perspective view of a barrier such as used for a road divider.

In FIGS. 1, 2, 3, and 4 there is shown mounting apparatus 1 comprising a vertically extending rigid member 2 having an upper end 2*a*, a lower end 2*b* and an intermediate portion 2*c*, an L or angle shaped clamping arm member 3 having a generally horizontal arm 3*a* with end portion 3*a*' and a generally vertical arm 3*b* with an end portion 3*b*', a hinge and pivot axis assembly 5 coupling the end of said generally horizontal arm 3*a* to said intermediate portion 2*c*, a lever arm 6 secured to said horizontal arm 3*a* proximate the end 3*a*' thereof for pivoting said clamping arm member 3 about said hinge and pivoting axis 5 to widen and enlarge the space between the generally vertical arm 3*b* and said lower end 2*b* of said vertically extending rigid member 2 and thereby encompass the top of a barrier 11. A spring 4 is positioned in between and attached to lever arm 6 via 4*a* and rigid member 2 to apply gripping compression between the clamping arm member 3 and the rigid member 2 so as to secure the mounting apparatus 1 to the barrier 11. A sign 10 is attached to a mounting bracket 9*a* positioned on supporting member 9 connected to the upper end 2*a* of the vertically extending rigid member 2.

The L or angle shaped clamping member 3 is shown with mounting or strengthening bars 3'. However, the member 3 may be a single or solid body without the bars 3'.

As shown in FIGS. 1, 2, 3, and 4, the mounting apparatus includes gripping members 7*a*, and 7*b* positioned on rigid member 2 and gripping members 7*c* positioned on the mounting bars 3' positioned on the clamping arm member 3. The gripping members 7*a*, 7*b*, 7*c* are for increasing and enhancing contact between the mounting apparatus 1 and barrier 11. These may be constructed out of any suitable material such as metal, plastic, composites, and so forth.

Also shown in FIGS. 1, 2, 3, and 4 are studs or cleats 8*a* on the surface of the gripping members 7*c*. These may also be on the surfaces of the gripping members 7*a* and 7*b*. The studs or cleats are of any suitable geometric shape and design and are of any selected material sufficient to enhance the grips of the gripping members to the barriers. Typical materials include stainless steel, carbide steel, titanium, plastic, rubber, and so forth.

Also shown are gripping pads 8*b* on gripping members 7*a* and 7*b*. These gripping pads may also be used on gripping members 7*c*. The gripping pads are of any suitable geometric shape and design and are of any selected material sufficient to enhance the grip of the gripping members to the barrier. Typical materials include stainless steel, carbide steel, titanium, plastic, rubber and so forth.

FIGS. 1, 2, 3, and 4 illustrate this invention with a fixed or stationary member 2 and a movable L or angle clamping arm 3. However, in other embodiments the member 2 may also be movable separate from or in conjunction with the clamping arm 3. Such embodiment may comprise two clamping arms 3 or two movable members 2.

Although FIGS. 1, 2, 3, and 4 illustrate the use of this invention with a sign, it may be used with other visual or sound communication means such as a signal, light, alarm, detector device and so forth.

The foregoing description of various preferred embodiments of the invention has been presented for purposes of illustration and description. It is not intended to be exhaustive or to limit the invention to the precise forms disclosed. Obvious modification or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims wherein interpreted in accordance with the breadth to which they are fairly, legally, and equitably entitle.

I claim:

1. Barrier mounting apparatus comprising a vertically extending rigid member having an upper end, a lower end and an intermediate portion, a clamping arm member having a generally horizontal arm with an end and a generally vertical arm with an end, a spring, and hinge assembly coupling the end of said generally horizontal arm to said intermediate portion, said hinge assembly having an axis, a lever arm secured to said horizontal arm proximate the end thereof for pivoting said clamping arm member about said axis so as to enlarge the space between said generally vertical arm and the lower end of said vertically extending rigid member to encompass the top of a barrier, and a mounting device on the upper end of said vertically extending rigid member to support a communication means.

2. The mounting apparatus of claim 1 including at least one gripping member at the lower end of said generally vertically extending rigid member and/or at the end of said vertical arm of said clamping arm member.

3. The mounting apparatus of claim 1 wherein the communication means includes at least one member selected from a sign, signal, light, alarm, and/or detector.

4. The mounting apparatus of claim 1 wherein the communication means is visual.

5. The mounting apparatus of claim 1 where the communication means produces sound.

6. The mounting apparatus of claim 2 wherein the gripping member is constructed to grip a concrete surface, a metal surface or a plastic surface.

7. The mounting apparatus of claim 2 wherein the gripping member contains cleats or studs.

8. The mounting apparatus of claim 7 wherein the cleats or studs are constructed of stainless steel, carbide steel, titanium, plastic, or rubber.

9. The mounting apparatus of claim 2 wherein the gripping member contains one or more gripping pads.

10. The mounting apparatus of claim 9 wherein the gripping pads are constructed of stainless steel, carbide steel, titanium, plastic or rubber.

11. Barrier mounting apparatus comprising a vertically extending rigid member having an upper end, a lower end and an intermediate portion, an L or angle shaped clamping arm member having a generally horizontal arm with an end portion and a generally vertical arm with an end portion, a hinge and pivot axis assembly coupling the end of said generally horizontal arm to said intermediate portion, a lever arm secured to said horizontal arm proximate the end thereof for pivoting said clamping arm member about said axis so as to enlarge the space between said generally vertical arm and the lower end of said vertically extending rigid member to thereby encompass the top of a barrier, a spring positioned in between and attached to the lever arm and rigid member to apply gripping compression between the clamping arm member and the rigid member so as to secure the mount apparatus to the barrier, and a mounting device on the upper end of said vertically extending rigid member to support a communication means.

12. The mounting apparatus of claim 11 including at least one gripping member at the lower end of said generally vertically extending rigid member and/or at the end of said vertical arm of said clamping arm member.

13. The mounting apparatus of claim 12 wherein each gripping member is constructed to grip a concrete surface, a metal surface and/or a plastic surface.

14. The mounting apparatus of claim 11 wherein the communication means includes at least one member selected form a sign, signal, light, alarm, and/or detector.

15. The mounting apparatus of claim 11 wherein the communication means is visual.

16. The mounting apparatus of claim 11 where the communication means produces sound.

* * * * *